United States Patent [19]

Reitz

[11] 4,271,900

[45] Jun. 9, 1981

[54] APPARATUS WITH EXPANDABLE TUBE BUNDLE

[75] Inventor: Charles F. Reitz, Wilmington, Del.

[73] Assignee: E. I. Du Pont de Nemours and Company, Wilmington, Del.

[21] Appl. No.: 920,122

[22] Filed: Jun. 28, 1978

[51] Int. Cl.[3] ..... F28D 7/10; F28F 9/00

[52] U.S. Cl. ..... 165/162; 165/163

[58] Field of Search ..... 156/180, 296; 165/159, 165/172, 158, 162

[56] References Cited

U.S. PATENT DOCUMENTS

| | | | |
|---|---|---|---|
| 3,137,638 | 6/1964 | Kumpf et al. | 165/172 X |
| 3,163,585 | 12/1964 | Metcalfe et al. | 165/172 |
| 3,380,513 | 4/1968 | Staats, Jr. | 165/1 |
| 3,419,069 | 12/1968 | Baker et al. | 165/158 |
| 3,438,434 | 4/1969 | Smith | 165/159 X |
| 3,526,275 | 9/1970 | Vance et al. | 165/159 X |
| 4,136,734 | 1/1979 | Sasaki et al. | 165/111 |
| 4,143,709 | 3/1979 | Cunningham | 165/172 |

FOREIGN PATENT DOCUMENTS

| | | |
|---|---|---|
| 835173 | 10/1975 | Belgium . |
| 2615977 | 10/1976 | Fed. Rep. of Germany . |

*Primary Examiner*—Samuel Scott
*Assistant Examiner*—Theophil W. Streule, Jr.

[57] ABSTRACT

An apparatus comprising in combination (a) an elongated bundle of flexible, relatively small diameter, thin walled hollow polymeric tubular elements of various lengths, in a twist configuration having a length greater than the housing and a lateral dimension securing means at both ends, (b) a housing means for said bundle wherein said bundle extending entirely within said housing means with said bundle anchored to said housing means in said twisted configuration, (c) means for securing in fluid tight arrangement said housing means to said lateral dimension securing means and (d) circular spacers for the tubes, the longer length of said bundle when secured within said housing means causing a bowing of said tubes that permits flexing and moving of the tubular elements in said bundle.

10 Claims, 3 Drawing Figures

1
2
3
4
5
6
7
8
9
10
11
12
13
14

APPARATUS WITH EXPANDABLE TUBE BUNDLE

DESCRIPTION

1. Technical Field

This invention relates to a flexible tube and shell apparatus. More specifically, this invention relates to an apparatus having hollow, flexible tubular units for fluids to pass through and a housing or shell surrounding the tubular units so that one fluid can be passed through the apparatus between the shell and the tubular units and another fluid can be passed through the tubular units with the flexible tubes in a twist configuration with respect to the individual tubes from one end to the other end.

2. Background Art

Heat exchanger apparatuses with flexible tubes are described in the prior art, e.g., U.S. Pat. Nos. 3,277,959; 3,391,041; 3,391,042; 3,380,513; 3,848,660; 3,526,275; 3,662,817 and 3,315,740. Heat exchangers described in the aforesaid patents possess tapes and screen baffles to keep the flexible tubes from rubbing against the housing around said tubes and to effect a suitable heat transfer rate. At high fluid flows the tubes tear free of said tapes thereby in some cases requiring thicker tube walls because of the tube welds. The thicker walls reduce heat transfer rate. Said tapes and baffle also tend to filter out dirt in sedimentary deposits that is very difficult and in some cases impossible to remove.

Prior art flexible tube heat exchangers do not attain maximum heat transfer due to the tendency of the flexible tubes to remain parallel to each other thereby permitting the tubes to occupy less than all of the available volume within the housing of said heat exchanger. This provides a bypass route for the fluid passing through the shell side of the exchanger.

In the operation of conventional heat exchangers equipped with either rigid tubular elements or flexible tubular elements, the shell side of the tubular elements tend to build up or cake with solid material from the fluid, e.g., river water, used as the heat exchange medium, thereby decreasing the heat exchange efficiency and interfering with the flow patterns in the exchanger. Most exchangers therefore have to be shutdown frequently to remove the solid material before the efficiency of the heat exchanger falls below some desired minimum. The same buildup can occur when the shell side of the tubular elements contains a fluid containing material which can be separated out as a solid during its presence in the heat exchanger.

DISCLOSURE OF INVENTION

Now it has been found that when conventional flexible tube heat exchangers are provided with tubular elements set in a twist configuration in a housing such that the twist amounts to 1°-25° per foot of tubular bundle length and when circular spacers arranged from 6-30 inches apart are provided for said tubular elements, the tubular elements are capable of flexing and moving and cannot lay parallel to one another, thereby reducing buildup of solid particles thereon. Thus brackish water may be used as a heat transfer medium without problems in buildup of sediment between the tubes. The spacers are used to effect more efficient flow patterns than when the tubes are held by old conventional spacers and tapes. The absence of tape welds makes it possible to use thin walled tubes to attain maximum heat transfer rates in heat exchangers and more efficient ion transfer in ion exchangers. The use of spacers instead of tapes also causes a flow pattern of the fluid such that sediment deposits from the fluid tend to be washed through the exchanger.

Accordingly, in an apparatus comprising in combination an elongated bundle of flexible, relatively small diameter, thin walled, hollow, polymeric, tubular elements and a housing means therefor extending the length of said bundle, said bundle comprising a plurality of said tubular elements with open terminal portions and a lateral dimension securing means for the plurality of said tubular elements cooperating with the terminal portions of said tubular elements, said housing means entirely surrounding said elongated bundle and defining a zone for fluid passage around said bundle, said housing having inlet and outlet means and having means for securing itself to said lateral dimension securing means in a fluid tight arrangement, the length of said housing is selected and determined by the length of the elongated bundle, the improvement wherein the tubular elements in each bundle vary in length from 0.1-1.0 inch per foot of bundle length, preferably 0.2-0.6 inch per foot of bundle length, said tubular elements forming a bundle set in a twisted configuration, said twist amounting to from 1°-25° per foot of bundle length, preferably 6°-15° per foot of bundle length as measured by the angle of turn that the tubes in one terminal portion of the bundle are to the tubes in the other terminal portion, the tube bundle having a length 0.5-5% greater than the housing length for said tubes, preferably 1.0-3%, said tubular elements passing through circular spacers having an area of up to 80% of the inside cross-sectional area of the housing means made up of 1-600 holes through which said tubular elements pass and an area of 20% or more of the cross-sectional area made up of one opening through which said tubular elements pass, said spacers located at intervals of from 6-30 inches apart, preferably 18-24 inches and rotated with respect to the opening having an area of 20% or more of the area of the spacer relative to the adjacent spacers, said rotation ranging from 45°-315°, the number of tubes passing through each hole ranging from 1-100.

The preparation of conventional flexible tube apparatus for use as heat exchangers is known in the art, e.g., U.S. Pat. Nos. 3,277,959; 3,391,041; 3,391,042 and 3,315,740. Said U.S. patents are hereby incorporated by reference.

The tubular elements are generally formed of a suitable thermoplastic polymer. The tubular elements are preferably formed of a suitable polyflurinated plastic material and in sizes as disclosed in U.S. Pat. No. 3,228,456. Particularly adaptable are polymers and copolymers of tetrafluoroethylene sold under the trade name Teflon ® by E. I. du Pont de Nemours and Company and polypropylene. Representative examples of such polyfluorinated thermoplastic polymers include polytetrafluoroethylene modified with polyhexafluoropropylene, copolymers of tetrafluoroethylene and perfluoropropylvinyl ether, tetrafluoroethylene, ethylene and hexafluoroacetone (Tefzel ® manufactured by E. I. du Pont de Nemours and Company) and fluorinated ion exchange polymers. However, other polymers may be used without departing from the spirit of the invention. Any organic polymeric compositions that are thermoplastic, possess suitable compatability with the fluids handled, possess adequate properties such as strength at the desired operating conditions and further possess adequate thermal conductivity for the desired use may also be used. Representative organic polymeric compositions also include polymers of aliphatic olefins, e.g., homopolymers and copolymers of ethylene, propylene, butene-1, pentene-1, hexene-1, octene-1, decene-1, butadiene, styrene; polymers of vinyl halides, e.g., vinyl chloride, vinyl fluoride, vinylidene fluoride; polymers of amides, e.g., hexamethylene adipamide, hexamethylene, sebacamide, caprolactam, etc.; polyacetals, e.g., polyoxymethylene, formaldehyde copolymers; polyaromatic ethers, e.g., polyphenylene oxide; polyurethanes; polyesters, e.g., polycarbonates, polyacrylates, polyalkylene dicarboxylates; chlorinated polyethers, etc.

The fluorinated ion exchange polymers possess pendant side chains containing sulfonyl groups attached to carbon atoms having at least one fluorine atom connected thereto and are disclosed in U.S. Pat. Nos. 3,282,875; 3,041,317; 3,718,627 and 3,560,569.

The fluorinated ion exchange polymers are prepared from monomers which are fluorinated or fluorine substituted vinyl compounds. The polymers are made from at least two monomers with at least one of the monomers coming from each of the two groups described below. The first group is fluorinated vinyl compounds such as vinyl fluoride, hexafluoropropylene, vinylidene fluoride, trifluoroethylene, chlorotrifluoroethylene, perfluoro(alkyl vinyl ether), tetrafluoroethylene and mixtures thereof.

The second group is the sulfonyl-containing monomers containing the precursor $-SO_2F$ or $-SO_2Cl$. One example of such a comonomer is $CF_2{=}CFSO_2F$. Additional examples can be represented by the general formula $CF_2{=}CFR_fSO_2F$ wherein $R_f$ is a bifunctional perfluorinated radical comprising 2–8 carbon atoms. The particular chemical content or structure of the radical linking the sulfonyl group to the copolymer chain is not critical but such must have a fluorine atom attached to the carbon atoms to which is attached the sulfonyl group. If the sulfonyl group is attached directly to the chain, the carbon in the chain to which it is attached must have a fluorine atom attached to it. Other atoms connected to this carbon can include fluorine, chlorine or hydrogen. The $R_f$ radical of the formula above can be either branched or unbranched, i.e., straight-chained and can have one or more ether linkages. It is preferred that the vinyl radical in this group of sulfonyl fluoride containing comonomers be joined to the $R_f$ group through an ether linkage, i.e., that the comonomer be of the formula $CF_2{=}CFOR_fSO_2F$. Illustrative of such sulfonyl fluoride containing comonomers are $$CF_2{=}CFOCF_2CF_2SO_2F,$$

$$CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

$$CF_2{=}CFCF_2CF_2SO_2F, \text{ and}$$

-continued $$CF_2{=}CFOCF_2\underset{\underset{\underset{\underset{CF_3}{|}}{O}}{|}}{\overset{\overset{CF_2}{|}}{C}}FOCF_2CF_2SO_2F.$$

The most preferred sulfonyl fluoride containing comonomer is perfluoro(3,6-dioxa-4-methyl-7-octenesulfonyl fluoride), $$CF_2{=}CFOCF_2\underset{\underset{CF_3}{|}}{C}FOCF_2CF_2SO_2F.$$

The preparation of tetrafluoroethylene polymers and copolymers thereof with other fluorocarbons or hydrocarbons are well known in the art as are the other polymeric compositions.

The tube bundles of the apparatus of this invention are prepared from tubes whose variation in length range from 0.1–1.0 inch per foot of tube length. These tube bundles can conveniently be prepared by the use of a trough having a bend that is generally at least 5°, preferably 10°–15°, of any desired length, into which tubular elements are laid. Due to this bend in the trough, the tubes laid therein will vary in length from the adjacent tubes. The tubes are then cut to conform to the desired length of the bundles by a vertical cutting of both ends of the tubes. The tube ends are then sealed together with heat by the methods described in U.S. Pat. No. 3,315,740 after the desired number and type of spacers have been placed in the trough so that the tubular elements pass through the holes in the spacer as desired.

Spacers are used to help keep the tubular elements from nesting by more evenly distributing the tubular elements within the housing walls.

The spacers are placed 0.5–2.5 feet apart. This depends on the particular system being used. The design of the spacer so that up to 80% of the area is made up of holes for the tubular elements to pass through is unique and causes the flow of fluid to avoid parallel flow by arranging the opening that amounts to 20% of the area of the spacer to be turned at least 45° from the adjacent spacer. There can be from 1–600 holes in the area amounting to up to 80% of the total spacer area. Each hole is capable of having 1–100 tubular elements pass through. The remaining area of 20% or more of the spacer is one opening through which from 1–100 tubular elements can pass. The passage of some fluid through the spacer holes between the circumference of the holes and the outer surface of the tubular elements permits minimal parallel flow of the fluid, but results in a reduction in the wear of the tubular elements. The turning of the spacers with respect to the adjacent spacer can be from 45°–315°, however, they are preferably turned from 90°–270°, and most preferably 180° from the adjacent spacer to prevent parallel flow of the fluid on the shell side of the exchanger. This arrangement of the spacers directs the majority flow of fluid on the shell side of the tubular elements through the open sections thereby creating a cross flow that improves the heat transfer rate across the tubes. Some fluid passes around the tubes between the tubes and the hole through which they pass but the majority passes through the open sections that are at least 45° turned from the previous spacer thereby preventing channeling. The majority flow is a cross flow with some parallel flow occurring around the tubes in the holes.

The spacers of this invention are generally circular in shape and sized to fit tightly against the inside circumference of the housing in such a manner that the fluid in the shell side of the exchanger will only minimally flow around the spacers.

The tubes are pulled from creel, straightened and threaded through the spacers. One end of the tubes is fused together and to a connector ring that surrounds the fused tubes. The tubes are then bowed by laying them in a trough with a bend (angle of bend disclosed herein) with the spacers in place and the second end of the tubes is fused together and to a connector ring that surrounds the fused tubes. The fusing of the tubular elements at the ends can be performed one one end before subjecting them to the desired bend followed by twisting and fusing the other end or both ends may be fused after they have been subjected to the desired bend and twist. Both ends may be fused before any twist. In this case, the tube bundle is twisted when the ends are anchored to the housing means.

The spacers are anchored in the desired position by the use of a rod running the length of the tube bundle through each spacer at its outer edge and fused to the other tubes and to a sheath or header ring as a tubular element is. The rod is generally of plastic material (e.g., Teflon®). The polymeric materials described above may also be used to make said rods. The ends of the rods are sealed with the honeycomb of tubular elements to anchor the rods at both ends. There are four rods anchoring the spacers in each bundle, said rods spaced about 90° apart at the outer circumference of the tubular elements. The rod size is generally of the same outside diameter as the tubes. However, larger outside diameter rods can also be used.

The apparatus of this invention results in three improvements over conventional apparatuses. These are (1) reduced buildup of sediment on the shell side of the tubes, (2) reduced tube leaks (due to absence of tapes), (3) increased overall heat transfer due to lower velocity of fluids on the shell side without sedimentary deposits and reduced nesting of the tubes. The three critical requirements in achieving the above improvements are the variation in length of the tubes, the twist set of the tubes, the spacers and bowed tubes. The bowed tubes are attained with the use of an excessive tube bundle length for the housing so that the tube ends must be pushed in toward each end of the housing before the bundles are locked to the housing in fluid tight arrangement. Thus, when the twisted tube bundle is inserted into the housing, the tube bundle ends are pushed into the housing before anchoring the terminal portions of the tube bundle in fluid tight arrangement with the terminal portion of the housing means bowing the tubes outwardly toward the housing. This excess length of the bundle of tubes amounts to 0.5–5% more than the housing length.

The terminal portions of the bundle of tubular elements are sealed in an arrangement within an annular member that cooperates with the lateral dimension securing means. The lateral dimension securing means and the means for attaching said securing means to the housing are known in the art. Any conventional means for accomplishing this may be used. U.S. Pat. No. 3,277,959 discloses the fluid tight arrangement between the lateral dimension securing means and the housing and details relating thereto.

What is meant by a conventional flexible tube apparatus is an apparatus known in the art as heat exchanger which has flexible, relatively small diameter, thin walled, hollow, polymeric tubular elements. The preferred tube sizes of this invention are from 0.125 inch O.D. to 0.305 inch O.D. Such exchangers are described, for example, in U.S. Pat. Nos. 3,277,959; 3,391,041; 3,391,042; 3,315,740; 3,616,022; 3,417,812; 3,363,680 and 3,526,274.

In operation the apparatus of this invention may be used to exchange heat between two fluids. The fluids, e.g., may be sulfuric acid of different strengths and different temperatures. A process might involve liquids inside the tubes and gas on the shell side, e.g., sulfur dioxide gas on the shell side and water in the tubes. The apparatuses of this invention are most often utilized to exchange heat from one fluid to another fluid where corrosiveness of one fluid or both is a factor to be considered.

It is important that the cleaner fluid being used be the fluid inside the tubes and the one not as clean be the fluid outside the tubes. The flow of heat from the shell side of the tubes into the tubes or from the inside of the tubes toward the shell side also tends to cause the tubes to bow.

The apparatus of this invention when the tubular elements are fabricated from fluorinated ion exchange polymers with sulfonyl groups may be used to separate metals from plating solutions with reduced build up of sediment on the shell side of the tubular elements from the plating solutions.

The housing means may be fabricated from steel or other metals and it may be uncoated or coated or lined with a polymeric material where corrosiveness is a factor. The polymer used for this coating may be selected from the polymers described herein but is not intended to be limited to said polymers. Thus, coating or lining may be of polymers that are not thermoplastic.

BRIEF DESCRIPTION OF THE DRAWINGS

Referring now to FIGS. 2 and 3, spacer 2 is shown with holes through which a plurality of tubular elements pass making up as much as 80% of the area of the spacer. An opening 11 that amounts to 20% or more of the surface area of the spacer is provided for a plurality of tubular elements. An identical spacer 3 is shown rotated 180° with respect to identical spacers 2.

Referring now to FIG. 1, rods 7 and 8 are fused into the honeycombed ends 6 of the tubular elements in the same manner as an individual tubular element. Rod 7 extends through holes on spacers 2, 3, 4 and 5 and tie into the other terminal portion of the tubular elements in the same manner as an individual tubular element. Rod 8 also extends through the spacers and is fused to both ends of the bundle but is located about 90° from rod 7. Two other rods spaced 90° apart and 90° from other rods make up a total of four rods which anchor the spacers. The spacers are located at intervals defined herein between the terminal portions of the tube bundle shown and are each rotated 180° with respect to the adjacent spacer. The tube bundle and rods are enclosed within a housing means 12 having inlet means 13 and outlet means 14. The tubular elements of the bundle are in a twist configuration which, for purposes of illustration, are intended to amount to 360°.

Figures 1, 2, 3:
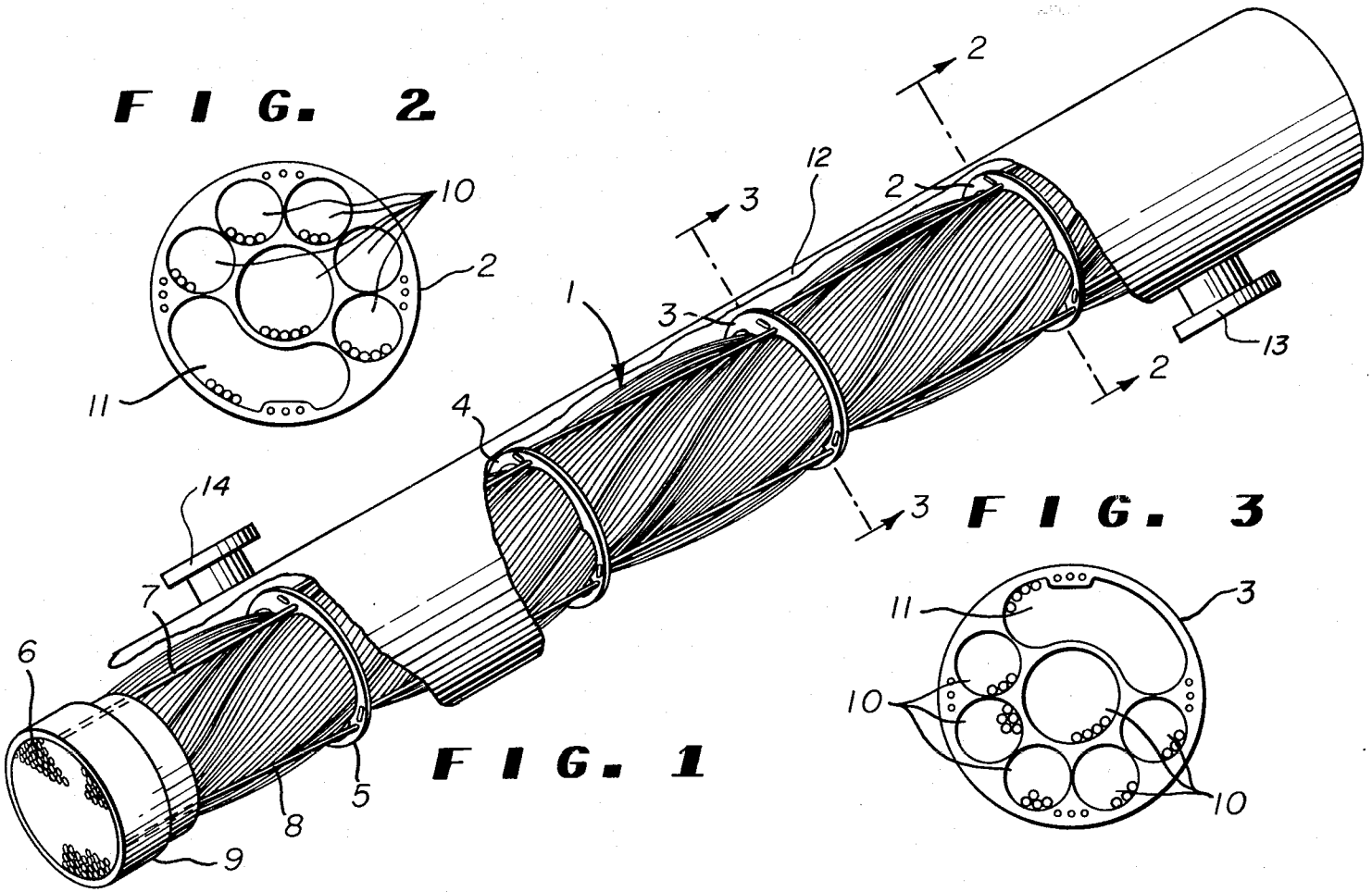
FIG. 1 is an isometric illustration of a partly cut-away apparatus of the invention, having a tube bundle with a twist configuration also showing the rods that anchor the spacers in place.
FIG. 2 is a cross section of the tube bundle of FIG. 1 at a spacer showing the openings in the spacer and its position relative to an adjacent spacer.
FIG. 3 is a cross section of the tube bundle of FIG. 1 at the spacer adjacent to the spacer in FIG. 2 showing the openings in the spacer and its position relative to an adjacent spacer.

The plurality of tubular elements making up the bundle 1 are sealed together at both ends so that the individual tubes are parallel to each other and packed together with a minimum of space between them to form a "honeycomb" effect 6. A sheath or header ring 9 made up of polymer that can be the same as that of the tubular elements is bonded by fusing the sheath around the honeycomb of tubes. The finished bond leaves no passageway between the tube walls and sheath or between the tube walls themselves.

EXAMPLE 1

An apparatus with the features of the present invention was prepared with tubes of ¼ inch O.D. of a copolymer of tetrafluoroethylene and hexafluoropropylene (Teflon® FEP 160 made by E. I. du Pont de Nemours and Company) that varied in length from 16 feet to 16 feet 8 inches and arranged in a 10° per foot of bundle length twist and in a housing such that there will be a 2% excess in length of the tubes. The spacers were 18 inches apart with holes large enough for 80 tubes per each hole. Raw river water from the James River at Richmond, Va. was fed to the shell side of the apparatus and steam was fed to the inside of the tubes and data taken to calculate the overall heat transfer coefficient Uo. The following data represent average data from four runs:

| Steam | | Water Flow | Overall Coefficient |
|---|---|---|---|
| Inlet Temp °F. | Exit Temp °F. | GPM | Uo |
| 230 | 220 | 100 | 38 |
| 230 | 220 | 150 | 42 |
| 230 | 220 | 200 | 44 |
| 230 | 220 | 290 | 44 |

After six months of operation, there was essentially no buildup of salt or sediment on the shell side.

Comparison Example A

The procedure of Example 1 was followed except that a conventional apparatus with ¼ inch O.D. of the same Teflon® FEP 160 tubes 11 feet in length with welded tapes constructed as disclosed in U.S. Pat. No. 3,391,041 and 3,391,042 was used. The raw river water and steam flows were essentially parallel and gave the following overall heat transfer coefficient in a series of 3 runs:

| Steam | | Water Flow | Overall Coefficient |
|---|---|---|---|
| Inlet Temp °F. | Exit Temp °F. | GPM | Uo* |
| 230 | 220 | 100 | 34 |
| 230 | 220 | 150 | 36 |
| 230 | 220 | 200 | 40 |

*Uo = BTU/hr/ft$^2$ area/0° differential temperature

Comparative Example B

The apparatus of Comparative Example A was placed in commercial operations with steam and water at the same commercial facility with the same river water. After six months of operation, the shell side was plugged solid with silt.

Comparative Example C

A six footh long apparatus with a shell 8 inches in I.D. and 525 tubes ¼ inch in O.D, 0.025 inch wall thickness, of the same Teflon® FEP 160 of Example 1 making up a bundle of tubes with welded tapes to hold the tubes as disclosed in U.S. Pat. No. 3,391,042 with the screen baffle of U.S. Pat. No. 3,417,812. The apparatus was connected so that a slurry of sand in water could be recirculated through the shell side of said heat exchanger. After 16 hours of recirculating of the sand slurry, the exchanger had 62 lbs of sand deposited therein. After six flow interruptions, 28 lbs of that amount of sand were freed.

EXAMPLE 2

The procedure of Comparative Example C was followed except the apparatus was one constructed according to the disclosure in the present application of the same size, number of tubes, diameter and length as in Comparative Example C. One end of the tube bundle was honeycombed (tubes fused to each other and to a collector ring surrounding the honeycomb). The tubes were slipped through three spacers spaced approximately 18 inches apart, said spacers containing six circular holes in an area making up less than 80% of the cross sectional area of the spacer and one opening making up at least 20% of the cross sectional area. The spacers were rotated 180° from the adjacent spacer. The tube bundle was bent 8° in a trough having a 26 inch radius. The other end of the tubes in the bundle was honeycombed while the tube bundle was in this configuration. The longest tube was three inches longer than the shortest tube and the tube bundle length was three inches longer than the shell. The tube bundle was pulled through the shell and compressed and twisted 15° per foot of tube bundle length to fit the shell and locked into place. After 16 hours of recirculation of the same slurry makeup used in Comparative Example C, 16 lbs of the sand were deposited in the apparatus. One interruption of the recirculation freed 10 lbs of sand. After five additional flow interruptions, 4 lbs of additional sand were freed.

Tests were conducted with an apparatus of the present invention and another apparatus of the same size except that the spacers of the present invention were not used. The apparatuses were compared in a vertical position and in a horizontal position.

EXAMPLE 3

The apparatus of this invention comprised a shell six inches in diameter and six feet long. A tube bundle containing 106 tubes of ¼ inch O.D. with a wall thickness of 0.025 inch was honeycombed at one end. The tubes were slipped through three spacers and the bundle was then laid in a trough with a bend such that the tube lengths varied four inches from the shortest to the longest. The tube bundle was twisted 20° per foot of tube bundle length and the other end was honeycombed. The tube bundle length was one inch longer than the shell. The spacers included holes ⅞ inch in diameter in a triangular arrangement over an area amounting to 80% of the area of the spacer and over the area covering 20% of the area of the spacer was a single noncirculatar opening. There were 20 tubes passing through the noncircular opening. Six and seven tubes in some cases passed through each of the $\frac{7}{8}$ inch holes. The spacers were rotated 180° from the adjacent spacer. The tube ends were pushed together to fit the shell. The spacers were 18 inches apart.

Hot water was circulated inside the tubes and cold water on the shell side and then this arrangement was reversed. An overall heat transfer was calculated from data obtained with the apparatus in a vertical position and a horizontal position. The data obtained is summarized below:

| | |
|---|---|
| Water temp shell side | = 180° F. |
| Water temp inside tubes (AV) | = 108° F. |
| Uo (vertical position) | = 43 |
| Uo (horizontal position) | = 40 |
| Water temp shell side | = 108° F. |
| Water temp inside tubes (AV) | = 180° F. |
| Uo (vertical position) | = 44 |
| Uo (horizontal position) | = 40 |

Comparative Example D

The apparatus of Example 3 was made except that no spacers were used and the apparatus tested as in Example 3. The following data was obtained:

| | |
|---|---|
| Water temp shell side | = 180° F. |
| Water temp inside tubes (AV) | = 108° F. |
| Uo (vertical position) | = 30 |
| Uo (horizontal position) | = 22 |
| Water temp shell side | = 108° F. |
| Water temp inside tubes (AV) | = 180° F. |
| Uo (vertical position) | = 37 |
| Uo (horizontal position) | = 27 |

Comparative Example E

The apparatus of Example 3 was made except that the twist was 5° per foot of tube bundle and no spacers were used and the procedure of Example 3 was followed. The following data was obtained:

| | |
|---|---|
| Water temp shell side | = 170° F. |
| Water temp inside tubes (AV) | = 105° F. |
| Uo (vertical position) | = 28 |
| Uo (horizontal position) | = 24 |

The above data indicates that although the present invention gives better heat transfer in the vertical position, either the vertical or horizontal position results in better heat transfer than when no spacers are used.

BEST MODE

Example 1 represents the best mode of operation.

INDUSTRIAL APPLICABILITY

The apparatus of the present invention can be used where fluid heat exchange is required and more especially where these fluids are corrosive in nature. The apparatus of the present invention can also be used in applications where ion exchange or removal of ions from streams is required when the tubular units are fabricated from ion exchange material.

I claim:

1. In an apparatus comprising in combination an elongated bundle of flexible, relatively small diameter, thin walled, hollow, polymeric, tubular elements and a housing means therefor extending the length of said bundle, said bundle comprising a plurality of said tubular elements with open terminal portions and a lateral dimension securing means for the plurality of said tubular elements cooperating with the terminal portions of said tubular elements, said housing means entirely surrounding said elongated bundle and defining a zone for fluid passage around said bundle, said housing having inlet and outlet means and means for securing itself to said lateral dimension securing means in a fluid tight arrangement therewith, the length of said housing is selected and determined by the length of the elongated bundle, the improvement wherein the tubular elements in each bundle are of various lengths that range from 0.1–1.0 inch per foot of bundle length, said tubular elements forming an elongated bundle set in a twisted configuration, said twist amounting to from 1°–25° per foot of bundle length as measured by the angle of turn that the tubes in one terminal portion of the bundle are to the tubes in the other terminal portion the tube bundle having a length 0.5–5% greater than the housing length, said tubular elements passing through holes in circular spacers positioned substantially perpendicular to the tubular elements, having a cross sectional area substantially equal to the inside cross sectional area of the housing, further including a plurality of holes through which a portion of said tubular elements pass and an area of 20% or more of the inside cross sectional area of the housing defining one opening through which a portion of said tubular elements pass, the number of tubes passing through each hole or the opening ranging from 1–100, means for positioning said spacers at intervals of from 6–30 inches apart and wherein each spacer is rotated from 45°–315° C. with respect to the adjacent spacers.

2. The heat exchanger apparatus of claim 1 wherein the twist is 6°–15° per foot of bundle length.

3. The heat exchanger apparatus of claim 1 wherein the rotation of spacers is 90°–270°.

4. The heat exchanger apparatus of claim 1 wherein the rotation of spacers is 180°.

5. The heat exchanger apparatus of claim 1 having tubular elements of fluorinated ion exchange polymer.

6. The heat exchanger apparatus of claim 5 wherein the fluorinated ion exchange polymer contains sulfonyl groups.

7. The heat exchanger apparatus of claim 1 wherein the variation in length is from 0.2–0.6 inch per foot of bundle length.

8. The heat exchanger apparatus of claim 1 wherein the tube bundle length is 1–3% greater than the housing length.

9. The heat exchanger apparatus of claim 1 wherein the spacers are located 18–24 inches apart.

10. A process for exchanging heat with fluids of different temperatures using the apparatus of claim 1.

* * * * *